US010409187B2

(12) United States Patent
Takemori

(10) Patent No.: US 10,409,187 B2
(45) Date of Patent: Sep. 10, 2019

(54) TONER

(71) Applicant: KYOCERA Document Solutions Inc., Osaka (JP)

(72) Inventor: Toshiki Takemori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/041,127

(22) Filed: Jul. 20, 2018

(65) Prior Publication Data

US 2019/0025725 A1 Jan. 24, 2019

(30) Foreign Application Priority Data

Jul. 24, 2017 (JP) ..... 2017-142698

(51) Int. Cl.
*G03G 9/08* (2006.01)
*G03G 9/097* (2006.01)
*G03G 9/087* (2006.01)

(52) U.S. Cl.
CPC ..... *G03G 9/09733* (2013.01); *G03G 9/0819* (2013.01); *G03G 9/0825* (2013.01); *G03G 9/08755* (2013.01); *G03G 9/08782* (2013.01)

(58) Field of Classification Search
CPC ..... G03G 9/09733
USPC ..... 430/108.4
See application file for complete search history.

(56) References Cited

U.S. PATENT DOCUMENTS

2009/0035681 A1* 2/2009 Yuasa ..... G03G 9/0804 430/108.4
2018/0348656 A1* 12/2018 Kondo ..... C08G 63/12

FOREIGN PATENT DOCUMENTS

JP 2015-031767 A 2/2015

* cited by examiner

*Primary Examiner* — Mark A Chapman
(74) *Attorney, Agent, or Firm* — Studebake & Brackett PC

(57) ABSTRACT

Toner particles each contain a binder resin and a releasing agent. The releasing agent includes an ester mixture. The ester mixture includes an ester and a fatty acid. The ester includes at least one monoester. The monoester is a dehydration condensation product of a monovalent linear saturated carboxylic acid and a monovalent linear saturated alcohol. The fatty acid includes at least one monovalent linear saturated carboxylic acid. The fatty acid includes a monovalent linear saturated carboxylic acid having a carbon number of at least 14 and no greater than 24 but does not include a monovalent linear saturated carboxylic acid having a carbon number of less than 14 or a monovalent linear saturated carboxylic acid having a carbon number of greater than 24. The fatty acid has a melting point of 60° C. to 80° C. The fatty acid accounts for 5% by mass to 20% by mass of the ester mixture.

11 Claims, No Drawings

TONER

INCORPORATION BY REFERENCE

The present application claims priority under 35 U.S.C. § 119 to Japanese Patent Application No. 2017-142698, filed on Jul. 24, 2017. The contents of this application are incorporated herein by reference in their entirety.

BACKGROUND

The present disclosure relates to a toner. More particularly, the present disclosure relates to a toner containing a releasing agent.

It is known that a toner is enabled to form high-quality images by including, as a releasing agent, a material having a higher solid point than a common releasing agent.

SUMMARY

A toner according to an aspect of the present disclosure includes a plurality of toner particles. The toner particles each contain a binder resin and a releasing agent. The releasing agent includes an ester mixture. The ester mixture includes an ester and a fatty acid. The ester includes at least one monoester. The monoester is a dehydration condensation product of a monovalent linear saturated carboxylic acid and a monovalent linear saturated alcohol. The fatty acid includes at least one monovalent linear saturated carboxylic acid. The fatty acid includes a monovalent linear saturated carboxylic acid having a carbon number of at least 14 and no greater than 24 but includes neither a monovalent linear saturated carboxylic acid having a carbon number of less than 14 nor a monovalent linear saturated carboxylic acid having a carbon number of greater than 24. The fatty acid has a melting point of at least 60° C. and no greater than 80° C. The fatty acid accounts for at least 5% by mass and no greater than 20% by mass of the ester mixture.

DETAILED DESCRIPTION

The following describes an embodiment of the present disclosure. Unless otherwise stated, evaluation results (for example, values indicating shape and physical properties) for a powder are number averages of values measured for a suitable number of particles. The powder is for example toner mother particles, an external additive, or a toner. The term "toner mother particles" used herein refers to toner particles yet to be treated through adhesion of an external additive thereto.

A number average particle diameter of a powder is a number average value of equivalent circle diameters of primary particles of the powder (Heywood diameter: diameters of circles having the same areas as projected areas of the particles) measured using a microscope, unless otherwise stated. A value for a volume median diameter of a powder is measured based on the Coulter principle (electrical sensing zone technique) using "Coulter Counter Multisizer 3", product of Beckman Coulter, Inc., unless otherwise stated.

A value for a glass transition point (Tg) is measured in accordance with "Japanese Industrial Standard (JIS) K7121-2012" using a differential scanning calorimeter ("DSC-6220", product of Seiko Instruments Inc.), unless otherwise stated. A value for a softening point (Tm) is measured using a capillary rheometer ("CFT-500D", product of Shimadzu Corporation), unless otherwise stated. On an S-shaped curve (horizontal axis: temperature, vertical axis: stroke) measured using the capillary rheometer, the softening point (Tm) is a temperature corresponding to a stroke value of "(base line stroke value+maximum stroke value)/2". A value for a melting point (Mp) is a temperature of a peak indicating maximum heat absorption on a heat absorption curve (vertical axis: heat flow (DSC signal), horizontal axis: temperature) measured using a differential scanning calorimeter ("DSC-6220", product of Seiko Instruments Inc.), unless otherwise stated. Such an endothermic peak results from melting of a crystalline region. A melting point and a solid point of an ester mixture described below are each measured through a method described in association with Examples or a method conforming therewith.

The term "main component" of a material used herein refers to a component that accounts for the largest proportion of the mass of the material, unless otherwise stated.

Hereinafter, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl. The term "(meth) acrylonitrile" is used as a generic term for both acrylonitrile and methacrylonitrile.

A toner according to the present embodiment is an electrostatic latent image developing toner that can be favorably used in development of electrostatic latent images. The toner according to the present embodiment is for example a positively chargeable toner. The toner according to the present embodiment may be used as a one-component developer. A positively chargeable toner used as a one-component developer is positively charged by friction with a development sleeve or a blade in a developing device. Alternatively, a two-component developer may be prepared by mixing the toner and a carrier using a mixer (for example, a ball mill). Note that a positively chargeable toner included in a two-component developer is positively charged by friction with a carrier in a developing device.

The toner according to the present embodiment can for example be used in image formation in an electrophotographic apparatus (image forming apparatus). Preferably, the electrophotographic apparatus includes a charger and a light exposure device as an image forming section. Preferably, the electrophotographic apparatus further includes a developing device, a transfer device, and a fixing device. The following describes an example of image forming methods that are performed by electrophotographic apparatuses.

First, the image forming section of the electrophotographic apparatus forms an electrostatic latent image on a photosensitive member based on image data. Next, in a developing step, a developing device (specifically, a developing device having a toner-containing developer loaded therein) of the electrophotographic apparatus supplies the toner to the photosensitive member to develop the electrostatic latent image formed on the photosensitive member. The toner is charged by friction with a carrier, a development sleeve, or a blade in the developing device before being supplied to the photosensitive member. For example, a positively chargeable toner is positively charged. In the developing step, the toner (specifically, the charged toner) on the development sleeve disposed in the vicinity of the photosensitive member is supplied to the photosensitive member to adhere to the electrostatic latent image, which is an exposed region of the photosensitive member, and thus a toner image is formed on the photosensitive member. Toner in an amount corresponding to the amount of the toner consumed in the developing step is supplied to the developing device from a toner container containing toner for replenishment use. The photosensitive member is for example equivalent to a surface portion of the photosensitive drum. The development sleeve is for example equivalent to a surface portion of a development roller in the developing device.

Subsequently, in a transfer step, the transfer device of the electrophotographic apparatus transfers the toner image on the photosensitive member onto an intermediate transfer member, and then further transfers the toner image on the intermediate transfer member onto a recording medium. Thereafter, the fixing device of the electrophotographic apparatus fixes the toner to the recording medium by applying heat and pressure to the toner. As a result, an image is formed on the recording medium. A full-color image can for example be formed by superimposing toner images of four different colors: black, yellow, magenta, and cyan. Toner remaining on the photosensitive member after the transfer step is removed by a cleaning member. The intermediate transfer member is for example a transfer belt. The recording medium is for example a sheet of printing paper. The cleaning member is for example a cleaning blade. The toner image may be transferred by a direct transfer process as well as by an indirect transfer process. According to the direct transfer process, the toner image on the photosensitive member is directly transferred to the recording medium without using the intermediate transfer member. The toner may be fixed by a belt fixing process as well as by a nip fixing process involving the use of a heating roller and a pressure roller.

[Basic Features of Toner]

The toner according to the present embodiment has the following basic features. More specifically, the toner according to the present embodiment includes a plurality of toner particles. The toner particles each contain a binder resin and a releasing agent. The releasing agent includes an ester mixture. The ester mixture includes an ester X and a fatty acid Y. The ester X includes at least one monoester. The monoester is a dehydration condensation product of a monovalent linear saturated carboxylic acid and a monovalent linear saturated alcohol. The fatty acid Y includes at least one monovalent linear saturated carboxylic acid. The fatty acid Y includes a monovalent linear saturated carboxylic acid having a carbon number of at least 14 and no greater than 24 but includes neither a monovalent linear saturated carboxylic acid having a carbon number of less than 14 nor a monovalent linear saturated carboxylic acid having a carbon number of greater than 24. The fatty acid Y has a melting point of at least 60° C. and no greater than 80° C. The fatty acid Y accounts for at least 5% by mass and no greater than 20% by mass of the ester mixture.

The inventors of the present disclosure have found that it is possible to reduce the yield of UFPs while improving post-fixing releasability of the toner and heat-resistant stability of the toner through the toner having the above-described basic features. The following describes possible reasons for such an effect. Note that the term UFPs means particles having a diameter of no greater than 0.1 μm.

As a result of the ester mixture including the fatty acid Y, it is possible to provide a toner that has excellent post-fixing releasability and excellent heat-resistant stability. Specifically, the fatty acid Y includes at least one monovalent linear saturated carboxylic acid. The fatty acid Y includes a monovalent linear saturated carboxylic acid having a carbon number of at least 14 and no greater than 24 (referred to below as a "$C_{14-24}$ monovalent linear saturated carboxylic acid") but includes neither a monovalent linear saturated carboxylic acid having a carbon number of less than 14 nor a monovalent linear saturated carboxylic acid having a carbon number of greater than 24. As a result, the fatty acid Y can be prevented from having an excessively low melting point. At the same time, the fatty acid Y can be prevented from having an excessively high melting point. For example, the fatty acid Y tends to have a melting point of at least 60° C. and no greater than 80° C. The toner can be prevented from having an excessively low melting point through the fatty acid Y being prevented from having an excessively low melting point. As a result, it is possible to provide a toner having excellent heat-resistant stability. The toner can be prevented from having an excessively high melting point through the fatty acid Y being prevented from having an excessively high melting point. As a result, it is possible to provide a toner having excellent post-fixing releasability.

The UFP yield can be reduced through the ester mixture including the ester X and the fatty acid Y. Specifically, the ester X includes at least one monoester. The monoester is a dehydration condensation product of a monovalent linear saturated carboxylic acid and a monovalent linear saturated alcohol. Thus, the ester X includes at least one linear ester. The fatty acid Y includes at least one monovalent linear saturated carboxylic acid. Thus, the ester X and the fatty acid Y are both linear. The ester X and the fatty acid Y therefore tend to have chemical structures similar to each other. The ester X in the form of the ester mixture is less crystallizable than the ester X alone. Accordingly, a releasing agent solidifies less easily after being volatilized when the releasing agent includes the ester mixture than when the releasing agent includes the ester X alone. Thus, the releasing agent solidifies at a lower solid point after being volatilized when the releasing agent includes the ester mixture.

As described above, the releasing agent according to the present embodiment solidifies at a low solid point after being volatilized. When the releasing agent is volatilized for some reason, the UFPs are produced due to volatilization of the releasing agent. However, the produced UFPs easily aggregate. According to the present embodiment, therefore, the UFPs produced when the releasing agent is volatilized for some reason easily become larger, providing particles having a diameter larger than the UFPs (referred to below as "large particles"). Note that the large particles do not count as the UFPs, and therefore the yield of the large particles is not included in the UFP yield. The UFP yield can therefore be restricted to a low level as long as image formation is performed using the toner according to the present embodiment. For example, the UFP yield can be restricted to a level lower than or equal to an environmental standard. As described above, the present embodiment is to reduce the UFP yield not by preventing production of the UFP but by facilitating produced UFPs to become larger. The releasing agent is for example volatilized when the toner is exposed to a high temperature. For example, the toner is likely to be exposed to a high temperature when the toner yet to be fixed is fixed to a recording medium. In such a situation, the releasing agent is likely to be volatilized.

The effect of the ester X being less crystallizable is not obtained if the ester mixture does not include the fatty acid Y. In this case, the UFPs are not facilitated to become larger when the releasing agent is volatilized. Consequently, the UFP yield may exceed the environmental standard. If the ester mixture includes the fatty acid Y and a different ester (an ester that is not a monoester) instead of the ester X, it is unlikely that the effect of the ester being less crystallizable is obtained. In this case, the UFPs are not facilitated to become larger when the releasing agent is volatilized. Consequently, the UFP yield may exceed the environmental standard. As described above, reduction in the UFP yield is achieved only when the ester mixture includes both the ester X and the fatty acid Y.

In order to obtain the above-described effect efficiently, the ester mixture preferably includes at least 5% by mass and no greater than 20% by mass of the fatty acid Y. An excessively low amount of the fatty acid Y makes it difficult to obtain the effect of the ester X being less crystallizable. Consequently, the UFP yield may exceed the environmental standard. An excessively large amount of the fatty acid Y makes it difficult to disperse the ester mixture in the toner particles. Consequently, heat-resistant stability of the toner may be reduced.

Preferably, releasing agent domains resulting from the ester mixture are dispersed in the binder resin in each of the toner particles. Preferably, a dispersion size of the releasing agent domains on a cross-section of each toner particle (referred to below simply as a "releasing agent domain dispersion size") is at least 0.40 μm and no greater than 1.00 μm. An excessively small releasing agent domain dispersion size may reduce post-fixing releasability of the toner. An excessively large releasing agent domain dispersion size may reduce heat-resistant stability of the toner. The releasing agent domain dispersion size is determined through a method described in association with Examples described below or a method conforming therewith.

Preferably, the toner particles contain at least 2.5% by mass and no greater than 7.5% by mass of the ester mixture. An excessively small amount of the ester mixture may reduce post-fixing releasability of the toner. An excessively large amount of the ester mixture may reduce heat-resistant stability of the toner. An excessively large amount of the ester mixture means more sources of the UFPs and may therefore allow the UFP yield to exceed the environmental standard. The inventors have confirmed that heat-resistant stability of the toner decreases and the UFP yield exceeds the environmental standard in a situation in which the amount of the ester mixture in the toner particles is greater than or equal to 10% by mass.

The following describes a preferable physical property of the ester mixture. The ester mixture including at least 5% by mass and no greater than 20% by mass of the fatty acid Y tends to have the following physical property P.

Physical property P: The ester mixture has a solid point lower than a melting point thereof. More specifically, ΔT calculated in accordance with the following formula is at least 10° C.

$$\Delta T = \text{melting point of ester mixture} - \text{solid point of ester mixture}$$

As a result of the ester mixture having the physical property P, the volatilized releasing agent solidifies far less easily. Thus, the volatilized releasing agent tends to have a lowered solid point. For example, the volatilized releasing agent tends to have a solid point of approximately 65° C. Accordingly, the UFPs are effectively facilitated to become larger. The above facilitates reduction in the UFP yield. For example, the UFP yield is easily restricted to a level lower than or equal to the environmental standard. The melting point of the ester mixture is a peak temperature of an endothermic peak at a lowest temperature on a DSC curve of the ester mixture obtained through the second heating. The solid point of the ester mixture is a peak temperature of an exothermic peak at a highest temperature on a DSC curve of the ester mixture obtained through cooling. The melting point and the solid point of the ester mixture are each determined through a method described in association with Examples described below or a method conforming therewith.

Fine particles tend to be produced in a situation in which the ester mixture having the physical property P is heated at a high temperature (for example, 220° C.). More specifically, the median diameter of the fine particles tends to be at least 30.0 nm and the total number concentration thereof tends to be no greater than $3.50\times10^6$ particles/cm$^3$ in a particle diameter distribution of the fine particles as determined on a number basis. As long as the ester mixture has the physical property P, therefore, the UFPs are further facilitated to become larger when the releasing agent is volatilized for some reason. Accordingly, reduction in the UFP yield is further facilitated. For example, the UFP yield is restricted to a level lower than or equal to the environmental standard more easily. The particle diameter distribution of the fine particles on a number basis is determined through a method described in association with Examples described below or a method conforming therewith.

[Examples of Materials of Toner]

The toner particles may each include a toner mother particle and an external additive adhering to a surface of the toner mother particle. The toner mother particles may be capsule toner mother particles or non-capsule toner mother particles. The capsule toner mother particles each include a toner core and a shell layer covering a surface of the toner core. The non-capsule toner mother particles each include a toner core and no shell layer.

<Toner Mother Particle>

(Toner Core)

A binder resin is typically a main component (for example, at least 85% by mass) of the toner cores. Accordingly, properties of the binder resin are thought to have a great influence on overall properties of the toner cores. Properties (specific examples include hydroxyl value, acid value, Tg, and Tm) of the binder resin can be adjusted by using different resins in combination for the binder resin. For example, the toner cores have a higher tendency to be anionic in a situation in which the binder resin is substituted with an ester group, a hydroxyl group, an ether group, an acid group, or a methyl group and have a higher tendency to be cationic in a situation in which the binder resin is substituted with an amino group.

The toner cores further contain a releasing agent in addition to the binder resin. The toner cores may further contain at least one of a colorant and a charge control agent. The following describes the components in order.

(Binder Resin)

The binder resin includes a polyester resin as a main component. The binder resin may be composed only of a polyester resin or may further include a thermoplastic resin other than the polyester resin. Examples of thermoplastic resins other than the polyester resin that can be used include styrene-based resins, acrylic acid-based resins, olefin-based resins, vinyl resins, polyamide resins, and urethane resins. Examples of acrylic acid-based resins that can be used include acrylic acid ester polymers and methacrylic acid ester polymers. Examples of olefin-based resins that can be used include polyethylene resins and polypropylene resins. Examples of vinyl resins that can be used include vinyl chloride resins, polyvinyl alcohols, vinyl ether resins, and N-vinyl resins. Furthermore, copolymers of the resins listed above, that is, copolymers obtained through incorporation of a repeating unit into any of the resins listed above may be used as a thermoplastic resin for forming the toner particles. For example, styrene-acrylic acid-based resins and styrene-butadiene-based resins are also usable as thermoplastic resins composing the binder resin. The following describes a polyester resin in detail.

(Polyester Resin)

The polyester resin is a copolymer of at least one alcohol and at least one carboxylic acid. Examples of alcohols that can be used in synthesis of the polyester resin include di-, tri-, and higher-hydric alcohols shown below. Examples of dihydric alcohols that can be used include diols and bisphenols. Examples of carboxylic acids that can be used in synthesis of the polyester resin include di-, tri-, and higher-basic carboxylic acids shown below.

Examples of preferable diols include aliphatic diols. Examples of preferable aliphatic diols include diethylene glycol, triethylene glycol, neopentyl glycol, 1,2-propanediol, α,ω-alkanediols, 2-butene-1,4-diol, 1,4-cyclohexanedimethanol, dipropylene glycol, polyethylene glycol, polypropylene glycol, and polytetramethylene glycol. Examples of preferable α,ω-alkanediols include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids, α,ω-alkane dicarboxylic acids, unsaturated dicarboxylic acids, and cycloalkane dicarboxylic acids. Examples of preferable aromatic dicarboxylic acids include phthalic acid, terephthalic acid, and isophthalic acid. Examples of preferable α,ω-alkane dicarboxylic acids include malonic acid, succinic acid, adipic acid, suberic acid, azelaic acid, sebacic acid, and 1,10-decanedicarboxylic acid. Examples of preferable unsaturated dicarboxylic acids include maleic acid, fumaric acid, citraconic acid, itaconic acid, and glutaconic acid. Examples of preferable cycloalkane dicarboxylic acids include cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Colorant)

A known pigment or dye matching a color of the positively chargeable toner can be used as a colorant. In order to form high-quality images using the positively chargeable toner, the toner cores preferably contain at least 1 part by mass and no greater than 20 parts by mass of a colorant relative to 100 parts by mass of the binder resin.

The toner cores may contain a black colorant. Carbon black can for example be used as a black colorant. Alternatively, a colorant that is adjusted to a black color using a yellow colorant, a magenta colorant, and a cyan colorant can be used as a black colorant.

The toner cores may contain a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Examples of cyan colorants that can be used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The releasing agent includes the ester mixture. The releasing agent may only include the ester mixture or may further include a releasing agent (additional releasing agent) that is not the ester mixture. The ester mixture includes the ester X and the fatty acid Y. Preferably, the ester mixture is a molten mixture of the ester X and the fatty acid Y.

The ester X may include only one monoester or may include two or more monoesters each having a different chemical structure. The monoester is a dehydration condensation product of a monovalent linear saturated carboxylic acid and a monovalent linear saturated alcohol. The two or more monoesters each having a different chemical structure may be: monoesters respectively including monovalent linear saturated carboxylic acids each having a different carbon number; monoesters respectively including monovalent linear saturated alcohols each having a different carbon number; or monoesters respectively including monovalent linear saturated carboxylic acids each having a different carbon number and also respectively including monovalent linear saturated alcohols each having a different carbon number.

The monovalent linear saturated carboxylic acid is represented by general formula $C_nH_{2n+1}COOH$. In this general formula, n represents an integer of at least 1, and preferably represents an integer of at least 14 and no greater than 24. The use of the $C_{14-24}$ monovalent linear saturated carboxylic acid facilitates the ester X to have a chemical structure that is very similar to the fatty acid Y. As a result, the UFPs are effectively facilitated to become larger when the releasing agent is volatilized for some reason, facilitating restriction of the UFP yield to a level less than or equal to the environmental standard. The use of the $C_{14-24}$ monovalent linear saturated carboxylic acid also allows the ester mixture to have a melting point within a desired temperature range. More specifically, the monovalent linear saturated carboxylic acid is preferably selected from the group consisting of myristic acid (carbon number: 14), palmitic acid (carbon number: 16), stearic acid (carbon number: 18), arachidic acid (carbon number: 20), behenic acid (carbon number: 22), and lignoceric acid (carbon number: 24).

The monovalent linear saturated alcohol is represented by general formula $C_nH_{2n+1}OH$. In this general formula, n represents an integer of at least 1, and preferably an integer of at least 14 and no greater than 24. The use of a monovalent linear saturated alcohol having a carbon number of at least 14 and no greater than 24 (referred to below as a "$C_{14-24}$ monovalent linear saturated alcohol") facilitates the ester X to have a chemical structure that is very similar to the fatty acid Y. As a result, the UFPs are effectively facilitated to become larger when the releasing agent is volatilized for some reason, facilitating restriction of the UFP yield to a level less than or equal to the environmental standard. The use of the $C_{14-24}$ monovalent linear saturated alcohol also allows the ester mixture to have a melting point within a desired temperature range. More specifically, the monovalent linear saturated alcohol is preferably selected from the group consisting of myristyl alcohol (carbon number: 14), palmityl alcohol (carbon number: 16), stearyl alcohol (carbon number: 18), arachidyl alcohol (carbon number: 20), behenyl alcohol (carbon number: 22), and lignoceryl alcohol (carbon number: 24).

In a situation in which the ester X includes only one monoester, the monoester in the ester X is preferably a dehydration condensation product of the $C_{14-24}$ monovalent linear saturated carboxylic acid and the $C_{14-24}$ monovalent linear saturated alcohol. In a situation in which the ester X includes two or more monoesters, the monoesters in the ester X are each preferably a dehydration condensation product of the $C_{14-24}$ monovalent linear saturated carboxylic acid and the $C_{14-24}$ monovalent linear saturated alcohol.

The fatty acid Y includes at least one monovalent linear saturated carboxylic acid including the $C_{14-24}$ monovalent linear saturated carboxylic acid. More specifically, the fatty acid Y is preferably at least one monovalent linear saturated carboxylic acid selected from the group consisting of myristic acid, palmitic acid, stearic acid, arachidic acid, behenic acid, and lignoceric acid. The fatty acid Y may include only one monovalent linear saturated carboxylic acid or may include two or more monovalent linear saturated carboxylic acids each having a different carbon number. In a situation in which the fatty acid Y includes two or more monovalent linear saturated carboxylic acids, the fatty acid Y having a melting point of at least 60° C. and no greater than 80° C. means a mixture of the monovalent linear saturated carboxylic acids having a melting point of at least 60° C. and no greater than 80° C. In a situation in which the fatty acid Y includes two or more monovalent linear saturated carboxylic acids, the ester mixture including at least 5% by mass and no greater than 20% by mass of the fatty acid Y means the ester mixture including at least 5% by mass and no greater than 20% by mass of a mixture of the monovalent linear saturated carboxylic acids.

In a situation in which the releasing agent includes an additional releasing agent, a compound known as a releasing agent of toner particles can be used as the additional releasing agent. An amount of the additional releasing agent is no greater than 3% by mass of the amount of the ester mixture, and is preferably less than 1% by mass.

(Charge Control Agent)

The charge control agent is for example used in order to improve charge stability or a charge rise characteristic of the positively chargeable toner. The charge rise characteristic of the positively chargeable toner is an indicator as to whether the positively chargeable toner can be charged to a specific charge level in a short period of time. The cationic strength of the toner cores can be increased through the toner cores containing a positively chargeable charge control agent. The anionic strength of the toner cores can be increased through the toner cores containing a negatively chargeable charge control agent.

(Shell Layer)

Preferably, the shell layers contain a thermoplastic resin. As a result of the shell layers containing a thermoplastic resin, it is possible to achieve both heat-resistant preservability and low-temperature fixability of the toner. In a situation in which the shell layers contain a styrene-acrylic acid-based resin, it is possible to improve charge stability of the toner in addition to achieving both heat-resistant preservability and low-temperature fixability of the toner. Therefore, the shell layers preferably contain a styrene-acrylic acid-based resin. In a situation in which the resin contained in the shell layers includes a unit substituted with at least one alcoholic hydroxyl group derived from 2-hydroxyethyl acrylate, 2-hydroxy propyl acrylate, 2-hydroxyethyl methacrylate, or 2-hydroxy propyl methacrylate, it is possible to improve the film quality of the shell layers.

The styrene-acrylic acid-based resin is a copolymer of at least one styrene-based monomer and at least one acrylic acid-based monomer. Examples of preferable styrene-based monomers that can be used in synthesis of the styrene-acrylic acid-based resin include styrene, alkyl styrenes, hydroxystyrenes, and halogenated styrenes. Examples of preferable alkyl styrenes include α-methylstyrene, m-methylstyrene, p-methylstyrene, p-ethylstyrene, and 4-tert-butylstyrene. Examples of preferable hydroxystyrenes include p-hydroxystyrene and m-hydroxystyrene. Examples of preferable halogenated styrenes include α-chlorostyrene, o-chlorostyrene, m-chlorostyrene, and p-chlorostyrene.

Examples of preferable acrylic acid-based monomers that can be used in synthesis of the styrene-acrylic acid-based resin include (meth)acrylic acid, (meth)acrylamide, (meth) acrylonitrile, alkyl (meth)acrylates, and hydroxyalkyl (meth)acrylates. Examples of preferable alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Examples of preferable hydroxyalkyl (meth) acrylates include 2-hydroxyethyl (meth)acrylate, 3-hydroxypropyl (meth)acrylate, 2-hydroxy propyl (meth)acrylate, and 4-hydroxybutyl (meth)acrylate.

<External Additive>

Unlike internal additives, the external additive is not to be present inside of the toner mother particles but to be selectively present only on surfaces of the toner mother particles. The external additive includes a plurality of external additive particles present on the surfaces of the toner mother particles. The toner mother particles and the external additive particles do not chemically react with one another and are physically connected to one another.

The external additive is for example used in order to improve fluidity of the toner particles or handleability of the toner. Preferably, an amount of the external additive is at least 0.5 parts by mass and no greater than 10 parts by mass relative to 100 parts by mass of the toner mother particles. In a situation in which the external additive includes two or more types of external additive particles, the total amount of the external additive particles is preferably at least 0.5 parts by mass and no greater than 10 parts by mass relative to 100 parts by mass of the toner mother particles.

Preferably, the external additive particles are at least one type of particles selected from the group consisting of silica particles and metal oxide particles. Examples of preferable metal oxides contained in the metal oxide particles include alumina, titanium oxide, magnesium oxide, zinc oxide, strontium titanate, and barium titanate. One type of external additive particles may be used independently, or two or more types of external additive particles may be used in combination. Preferably, the external additive particles have a particle diameter of at least 0.01 μm and no greater than 1.0 μm.

[Toner Production Method]

A method for producing the toner according to the present embodiment includes toner particle preparation. Preferably, a large number of the toner particles are formed at the same time in order that the toner particles can be produced efficiently. Toner particles that are produced at the same time are thought to have substantially the same structure as one another.

<Toner Particle Preparation>

Preferably, the toner particle preparation includes releasing agent preparation. For toner particles including toner mother particles and an external additive, the toner particle preparation preferably further includes toner mother particle preparation and external additive addition. For capsule toner mother particles, the toner mother particle preparation preferably includes toner core preparation and shell layer formation. For non-capsule toner mother particles, the toner mother particle preparation preferably includes toner core preparation but does not include shell layer formation.

(Releasing Agent Preparation)

Preferably, the releasing agent preparation includes synthesizing the ester X and mixing the ester X and the fatty acid Y. In the synthesizing the ester X, preferably, a monovalent linear saturated carboxylic acid and a monovalent linear saturated alcohol are caused to undergo dehydration condensation under known ester synthesis conditions.

In the mixing the ester X and the fatty acid Y, preferably, the ester X and the fatty acid Y are stirred at a high temperature. As a result, the ester X and the fatty acid Y are melt-mixed, and thus the ester X and the fatty acid Y are readily mixed in a homogeneous manner. This makes it easy to obtain the effect of the ester X being less crystallizable. The ester X and the fatty acid Y are preferably stirred at a temperature lower than the synthesis temperature of the ester X. For example, the ester X and the fatty acid Y are preferably stirred at a temperature selected from a temperature range of from 50° C. to 150° C.

(Toner Core Preparation) Preferably, the toner cores are prepared by a known pulverization method or a known aggregation method. These methods allow easy preparation of the toner cores.

According to the present embodiment, a resin including a polyester resin as a main component is used as the binder resin. Furthermore, a releasing agent including the ester mixture obtained through the above-described method as a main component is used.

(Shell Layer Formation)

Preferably, the shell layers are for example formed on surfaces of the toner cores according to an in-situ polymerization process, an in-liquid curing film coating process, or a coacervation process.

(External Additive Addition) The toner mother particles and the external additive are mixed using a mixer (for example, an FM mixer, product of Nippon Coke & Engineering Co., Ltd.). Through the mixing, the external additive is physically connected to the surfaces of the toner mother particles. Thus, a toner including a number of toner particles is obtained.

EXAMPLES

The following describes examples of the present disclosure. Table 1 shows toners TA-1 to TA-6 and TB-1 to TB-6 according to Examples and Comparative Examples. In Table 1, "Dispersion size" of "Releasing agent" indicates a releasing agent domain dispersion size on a cross-section of each toner particle. Table 2 shows releasing agents R-01 and R-11 to R-19 used in Examples and Comparative Examples.

TABLE 1

| | Binder resin | Carbon black | Releasing agent | | |
|---|---|---|---|---|---|
| Toner | Amount (parts by mass) | Amount (parts by mass) | Type | Amount (parts by mass) | Dispersion size (μm) |
| TA-1 | 90.0 | 5.0 | R-11 | 5.0 | 0.50 |
| TA-2 | 90.0 | 5.0 | R-12 | 5.0 | 0.51 |
| TA-3 | 90.0 | 5.0 | R-13 | 5.0 | 0.49 |
| TA-4 | 92.5 | 5.0 | R-11 | 2.5 | 0.30 |
| TA-5 | 87.5 | 5.0 | R-11 | 7.5 | 0.93 |
| TA-6 | 90.0 | 5.0 | R-18 | 5.0 | 0.98 |
| TB-1 | 90.0 | 5.0 | R-14 | 5.0 | 0.47 |
| TB-2 | 90.0 | 5.0 | R-15 | 5.0 | 0.54 |
| TB-3 | 90.0 | 5.0 | R-01 | 5.0 | 0.52 |
| TB-4 | 90.0 | 5.0 | R-16 | 5.0 | 0.54 |
| TB-5 | 90.0 | 5.0 | R-17 | 5.0 | 0.59 |
| TB-6 | 90.0 | 5.0 | R-19 | 5.0 | 1.04 |

TABLE 2

| | Ester | | Fatty acid | |
|---|---|---|---|---|
| Releasing agent | Type | Amount (parts by mass) | Type | Amount (parts by mass) |
| R-01 | E-1 | 100 | None | 0 |
| R-11 | E-1 | 95 | F-1 | 5 |
| R-12 | E-1 | 95 | F-2 | 5 |
| R-13 | E-1 | 95 | F-3 | 5 |
| R-14 | E-1 | 95 | F-4 | 5 |
| R-15 | E-1 | 95 | F-5 | 5 |
| R-16 | E-2 | 95 | F-1 | 5 |
| R-17 | E-3 | 95 | F-1 | 5 |
| R-18 | E-1 | 80 | F-1 | 20 |
| R-19 | E-1 | 75 | F-1 | 25 |

Table 3 shows esters E-1 to E-3 included in the releasing agents R-01 and R-11 to R-19. A carboxylic acid containing behenic acid as a main component shown in Table 3 contained 4 parts by mass of stearic acid, 14 parts by mass of arachidic acid, and 82 parts by mass of behenic acid. An alcohol containing behenyl alcohol as a main component contained 2 parts by mass of stearyl alcohol, 6 parts by mass of arachidyl alcohol, 90 parts by mass of behenyl alcohol, and 2 parts by mass of lignoceryl alcohol.

TABLE 3

| Ester | Carboxylic acid | Alcohol |
|---|---|---|
| E-1 | Containing behenic acid as main component | Containing behenyl alcohol as main component |
| E-2 | Containing behenic acid as main component | Glycerin |
| E-3 | Containing behenic acid as main component | Pentaerythritol |

Table 4 shows fatty acids F-1 to F-5 included in the releasing agents R-11 to R-19. "C12", "C14", "C16", "C18", "C20", "C22", and "C24" in Table 4 respectively mean lauric acid, myristic acid, palmitic acid, stearic acid, arachidic acid, behenic acid, and lignoceric acid.

TABLE 4

| | Amount (parts by mass) | | | | | | | Melting point |
|---|---|---|---|---|---|---|---|---|
| Fatty acid | C12 | C14 | C16 | C18 | C20 | C22 | C24 | (° C.) |
| F-1 | 0 | 10 | 10 | 20 | 60 | 0 | 0 | 71.0 |
| F-2 | 0 | 0 | 0 | 0 | 50 | 40 | 10 | 79.0 |
| F-3 | 0 | 20 | 60 | 20 | 0 | 0 | 0 | 62.6 |
| F-4 | 20 | 30 | 50 | 0 | 0 | 0 | 0 | 56.6 |
| F-5 | 0 | 0 | 0 | 0 | 0 | 100 | 0 | 81.5 |

The following first describes preparation methods and physical property measurement methods of the releasing agents R-01 and R-11 to R-19. The following then describes, in order, production methods, physical property measurement methods, evaluation methods, and evaluation results of the toners TA-1 to TA-6 and TB-1 to TB-6 according to Examples and Comparative Examples. In evaluations in which errors might occur, an evaluation value was calculated by calculating the arithmetic mean of an appropriate number of measured values in order to ensure that any errors were sufficiently small. The number average particle diameter was measured using a transmission electron microscope (TEM).

[Releasing Agent Preparation Method]

<Preparation of Releasing Agent R-01>

A four-necked flask (capacity: 1 L) equipped with a thermometer, a nitrogen inlet tube, a stirrer, and a cooling tube was charged with 50 parts by mass of a carboxylic acid (a carboxylic acid containing behenic acid as a main component) and 50 parts by mass of an alcohol (an alcohol containing behenyl alcohol as a main component). The internal temperature of the flask was raised up to 220° C. while introducing nitrogen into the flask and evaporating by-product water. The internal temperature of the flask was kept at 220° C. for 15 hours while continuing introduction of nitrogen and evaporation of by-product water. The internal pressure of the flask was standard pressure. A reaction occurred while the internal temperature of the flask was kept at 220° C.

Next, 20 parts by mass of ion exchanged water relative to 100 parts by mass of a reaction product was added into the flask. The flask contents were stirred for 30 minutes while the internal temperature of the flask was kept at 80° C. The flask was left to stand for 30 minutes. The flask contents underwent solid-liquid separation while the flask was left to stand. The liquid separated was removed from the flask and pH of the liquid was measured. Washing of the reaction product was repeated until the liquid was neutral. That is, adding ion exchanged water, stirring the flask contents, leaving the flask to stand, and removing the liquid separated from a solid in the flask were repeated in the stated order until the liquid was neutral. Once the liquid was neutral, the solid in the flask was heated up to 180° C. under a condition of a reduced pressure of 1 kPa. Through the heating, volatiles remaining in the solid were evaporated. Thus, the releasing agent R-01 was obtained. The releasing agent R-01 is equivalent to the ester E-1.

<Preparation of Releasing Agent R-11>

A four-necked flask (capacity: 1 L) equipped with a thermometer, a nitrogen inlet tube, a stirrer, and a cooling tube was charged with the ester E-1. The internal temperature of the flask was raised up to 100° C. Next, 5 parts by mass of the fatty acid F-1 relative to 95 parts by mass of the ester E-1 was added into the flask. The flask contents were stirred for 1 hour while the internal temperature of the flask was kept at 100° C. The internal temperature of the flask was then reduced to room temperature (approximately 25° C.). Through the above, the releasing agent R-11 was obtained.

<Preparation of Releasing Agents R-12 to R-15>

The releasing agents R-12 to R-15 were prepared according to the same method as the preparation method of the releasing agent R-11 in all aspects other than that the fatty acids F-2 to F-5 were used, respectively.

<Preparation of Releasing Agent R-16>

The ester E-2 was prepared according to the same method as the preparation method of the ester E-1 in all aspects other than that 75 parts by mass of a carboxylic acid (a carboxylic acid containing behenic acid as a main component) and 25 parts by mass of glycerin were used. The ester E-2 was used instead of the ester E-1. Other than the above-mentioned changes, the releasing agent R-16 was prepared according to the same method as the preparation method of the releasing agent R-11.

<Preparation of Releasing Agent R-17>

The ester E-3 was prepared according to the same method as the preparation method of the ester E-1 in all aspects other than that 80 parts by mass of a carboxylic acid (a carboxylic acid containing behenic acid as a main component) and 20 parts by mass of pentaerythritol were used. The ester E-3 was used instead of the ester E-1. Other than the above-mentioned changes, the releasing agent R-17 was prepared according to the same method as the preparation method of the releasing agent R-11.

<Preparation of Releasing Agents R-18 and R-19>

The releasing agent R-18 was prepared according to the same method as the preparation method of the releasing agent R-11 in all aspects other than that 80 parts by mass of the ester E-1 and 20 parts by mass of the fatty acid F-1 were used. The releasing agent R-19 was prepared according to the same method as the preparation method of the releasing agent R-11 in all aspects other than that 75 parts by mass of the ester E-1 and 25 parts by mass of the fatty acid F-1 were used.

[Releasing Agent Physical Property Measurement Method]

<Measurement of Melting Point and Solid Point of Releasing Agent>

With respect to each of the releasing agents R-01 and R-11 to R-19, 10 mg of a measurement sample (the releasing agent) was heated from room temperature to 150° C. at a heating rate of 10° C./minute, cooled to 0° C. at a cooling rate of 10° C./minute, and re-heated to 150° C. at a heating rate of 10° C./minute using a differential scanning calorimeter ("DSC-200", product of Seiko Instruments Inc.). A temperature of a peak at a lowest temperature (an endothermic peak) on a DSC curve obtained through the second heating was taken to be a melting point of the releasing agent. A temperature of a peak at a highest temperature (an exothermic peak) on a DSC curve obtained through the cooling was taken to be a solid point of the releasing agent. Measurement results are shown in Table 5. "ΔT" in Table 5 indicates a temperature difference calculated in accordance with the following formula.

$$\Delta T = (\text{melting point of releasing agent}) - (\text{solid point of releasing agent})$$

<Measurement of Number-Based Particle Diameter Distribution of Fine Particles Produced Through Heating>

An inlet of a fast response particle sizer ("FMPS 3091", product of TOKYO DYLEC CORP.) was attached to an outlet of a measuring device for simultaneous thermogravimetry and differential thermal analysis (TG/DTA) ("STA7200", product of Hitachi High-Tech Science Corporation). A discharge rate of the measuring device for simultaneous thermogravimetry and differential thermal analysis was 0.1 L/minute, and an intake rate of the fast response particle sizer was 10 L/minute. Thereafter, with respect to each of the releasing agents R-01 and R-11 to R-19, the measuring device for simultaneous thermogravimetry and differential thermal analysis was used to heat 10 mg of a measurement sample (the releasing agent) from room temperature to 220° C. at a heating rate of 20° C./minute and keep the measurement sample at 220° C. for 10 minutes. The particle diameter distribution (on a number basis) of fine particles being produced was measured at the same time as the initiation of a measurement program using the measuring device for simultaneous thermogravimetry and differential thermal analysis. Through the above, the number median diameter of the fine particles and the total number concentration of the fine particles were determined. The measurement results are shown in Table 5.

TABLE 5

| | | | | Fine particles produced through heating | |
|---|---|---|---|---|---|
| Releasing agent | Melting point (° C.) | Solid point (° C.) | ΔT (° C.) | Number median diameter (nm) | Total number concentration (particles/cm$^3$) |
| R-01 | 76.2 | 66.4 | 9.8 | 16.2 | $4.73 \times 10^6$ |
| R-11 | 75.9 | 65.9 | 10.1 | 33.9 | $3.28 \times 10^6$ |
| R-12 | 76.3 | 66.2 | 10.2 | 36.7 | $3.32 \times 10^6$ |
| R-13 | 75.5 | 65.0 | 10.5 | 54.0 | $2.06 \times 10^6$ |
| R-14 | 75.2 | 64.4 | 10.8 | 64.9 | $1.06 \times 10^6$ |
| R-15 | 76.5 | 66.9 | 9.5 | 28.9 | $3.68 \times 10^6$ |
| R-16 | 71.8 | 62.8 | 9.0 | 16.8 | $4.12 \times 10^6$ |
| R-17 | 78.7 | 70.0 | 8.7 | 15.0 | $4.10 \times 10^6$ |
| R-18 | 75.9 | 65.7 | 10.2 | 35.0 | $3.02 \times 10^6$ |
| R-19 | 75.9 | 65.5 | 10.4 | 33.1 | $3.15 \times 10^6$ |

[Toner Production Method]

<Production of Toner TA-1>

A four-necked flask (capacity: 5 L) equipped with a thermometer, a nitrogen inlet tube, a stirrer, and a cooling tube was charged with 1,500 g of terephthalic acid, 1,500 g of isophthalic acid, 1,200 g of bisphenol A ethylene oxide adduct, and 800 g of ethylene glycol. The internal temperature of the flask was raised up to 250° C. while introducing nitrogen into the flask and stirring the flask contents. The internal temperature of the flask was kept at 250° C. for 4 hours while continuing introduction of nitrogen and stirring of the flask contents. The internal pressure of the flask was standard pressure. A reaction occurred while the internal temperature of the flask was kept at 250° C.

Next, 0.8 g of antimony trioxide, 0.5 g of triphenyl phosphate, and 0.1 g of tetrabutyl titanate were added into the flask. The internal pressure of the flask was reduced to 0.04 kPa, and the internal temperature of the flask was raised up to 280° C. The internal pressure of the flask was kept at 0.04 kPa and the internal temperature of the flask was kept at 280° C. for 6 hours. A reaction occurred while the internal pressure was kept at 0.04 kPa and the internal temperature was kept at 280° C.

Furthermore, 30.0 g of trimellitic acid (cross-linking agent) was added into the flask. The internal pressure of the flask was returned to standard pressure, and the internal temperature of the flask was reduced to 230° C. The internal pressure of the flask was kept at standard pressure and the internal temperature of the flask was kept at 230° C. for 1 hour. A reaction occurred while the internal pressure was kept at standard pressure and the internal temperature was kept at 230° C.

A reaction product was taken out of the flask and cooled to room temperature. Through the above, a polyester resin was obtained. The thus obtained polyester resin had a glass transition point of 53.8° C., a softening point of 100.5° C., a number average molecular weight (Mn) of 1,460, a molecular weight distribution (Mw/Mn) of 12.7, an acid value of 16.8 mgKOH/g, and a hydroxyl value of 22.8 mgKOH/g. This polyester resin was used as a binder resin.

The polyester resin in an amount of 90 parts by mass, carbon black ("MA100", product of Mitsubishi Chemical Corporation) in an amount of 5 parts by mass, and the releasing agent R-11 in an amount of 5 parts by mass were loaded into an FM mixer ("FM-20B", product of Nippon Coke & Engineering Co., Ltd.). The FM mixer contents were stirred at a rotational speed of 2,400 rpm for 180 seconds. The resultant mixture was melt-kneaded using a twin-screw extruder ("PCM-30", product of Ikegai Corp.) under conditions of a material feeding rate of 5 kg/hour, a shaft rotational speed of 150 rpm, and a set temperature (cylinder temperature) of 150° C. The resultant melt-kneaded product was cooled, and then coarsely pulverized using a pulverizer ("ROTOPLEX 16/8", product of former TOA MACHINERY MFG.). The resultant coarsely pulverized product was finely pulverized using a jet mill ("Model-I Supersonic Jet Mill", product of Nippon Pneumatic Mfg.). The resultant finely pulverized product was classified using a classifier ("Elbow Jet EJ-LABO", product of Nittetsu Mining Co., Ltd.). Thus, toner mother particles having a volume median diameter of 8.0 μm were obtained.

An FM mixer ("FM-10B", product of Nippon Coke & Engineering Co., Ltd.) was used to mix 100.0 parts by mass of the toner mother particles and 0.5 parts by mass of positively chargeable silica particles ("AEROSIL (registered Japanese trademark) REA90", product of Nippon Aerosil Co., Ltd.) over 5 minutes. The resultant mixture was sifted using a 200-mesh sieve (pore size: 75 μm). Through the above, the toner TA-1 including a number of toner particles was obtained.

<Production of Toners TA-2 and TA-3>

The toners TA-2 and TA-3 were obtained according to the same method as the production method of the toner TA-1 in all aspects other than that the releasing agents R-12 and R-13 were used, respectively.

<Production of Toner TA-4>

The amount of the releasing agent R-11 was changed to 2.5 parts by mass, and the amount of the binder resin was changed to 92.5 parts by mass. Other than that, the toner TA-4 was obtained according to the same method as the production method of the toner TA-1.

<Production of Toner TA-5>

The amount of the releasing agent R-11 was changed to 7.5 parts by mass, and the amount of the binder resin was changed to 87.5 parts by mass. Other than that, the toner TA-5 was obtained according to the same method as the production method of the toner TA-1.

<Production of Toners TA-6 and TB-1 to TB-6>

The toners TA-6, TB-1, TB-2, TB-3, TB-4, TB-5, and TB-6 were obtained according to the same method as the production method of the toner TA-1 in all aspects other than that the releasing agents R-18, R-14, R-15, R-01, R-16, R-17, R-19 were used, respectively.

[Toner Physical Property Measurement Method]

<Releasing Agent Domain Dispersion Size>

With respect to each of the toners TA-1 to TA-6 and TB-1 to TB-6, a measurement sample (the toner) was embedded in a visible-light curable resin ("ARONIX (registered Japanese trademark) D-800", product of Toagosei Co., Ltd.) to obtain a hardened material. The hardened material was cut at a cutting rate of 0.3 mm/second using an ultrathin piece forming knife ("SUMI KNIFE (registered Japanese trademark)", product of Sumitomo Electric Industries, Ltd., a diamond knife having a blade width of 2 mm and a blade tip angle of 45°) and an ultramicrotome ("EM UC6", product of Leica Microsystems) to form a flake sample having a thickness of 150 nm. The thus obtained flake sample was dyed through exposure to vapor of an aqueous ruthenium tetroxide solution on a copper mesh for 10 minutes. An image of a cross-section of the dyed flake sample was captured at a magnification of 10,000× using a scanning transmission electron microscope (STEM) ("JSM-7600F", product of JEOL Ltd.). The thus obtained TEM image was analyzed using image analysis software ("WinROOF", product of Mitani Corporation). Through the above, a releasing agent domain dispersion size (diameter) on the cross-section of each toner particle was measured. Note that average toner particles were selected as measurement targets from among the toner particles included in the measurement sample. The cross-section of each of the measurement target toner particles had a greatest dimension of at least 5.5 μm. For a releasing agent domain having a cross-section that was not a perfect circle, an equivalent circle diameter (a diameter of a circle having the same area as a projected area of the releasing agent domain) was measured for a dispersion size. The measurement results are shown in Table 1.

[Toner Evaluation Method]

With respect to each of the toners TA-1 to TA-6 and TB-1 to TB-6, heat-resistant stability of the toner, post-fixing releasability of the toner, and total UFP number concentration were evaluated.

<Heat-resistant Stability of Toner>

With respect to each of the toners TA-1 to TA-6 and TB-1 to TB-6, 3 g of the toner was loaded into a polyethylene container (capacity: 20 mL), and then the container was hermetically sealed. The container was left to stand in a thermostatic chamber set at 60° C. for 3 hours. Thereafter, the toner was taken out of the container and cooled to room temperature to give an evaluation toner.

The evaluation toner was placed on a 200-mesh sieve (pore size: 75 μm) of known mass. The mass of the toner before sifting was calculated by measuring the total mass of the sieve and the evaluation toner thereon. The sieve was set in POWDER TESTER (registered Japanese trademark), product of Hosokawa Micron Corporation, and the evaluation toner was sifted by shaking the sieve for 30 seconds at a rheostat level of 5 in accordance with a manual of POWDER TESTER. After the sifting, the mass of toner that did not pass through the sieve was calculated. Based on the mass of the toner before sifting and the mass of the toner after sifting, a toner passage rate (unit: % by mass) was determined in accordance with a formula shown below. "Mass of toner after sifting" in the formula was the mass of the toner that did not pass through the sieve, which in other words is the mass of the toner remaining on the sieve after sifting.

Toner passage rate=100×(mass of toner before sifting−mass of toner after sifting)/(mass of toner before sifting)

Heat-resistant stability was evaluated in accordance with the following standard. The evaluation results are shown in Table 6.

Excellent: Toner passage rate≥90%

Good: 80%≤Toner passage rate<90%

Poor: Toner passage rate<80%

<Post-Fixing Releasability of Toner>

With respect to each of the toners TA-1 to TA-6 and TB-1 to TB-6, the toner was loaded into a toner container of a multifunction peripheral ("TASKalfa 3510i", product of KYOCERA Document Solutions Inc.). Installation was performed to charge a developing device of the multifunction peripheral with the toner from the toner container. Thus, an evaluation apparatus was prepared.

A development bias of the evaluation apparatus was adjusted to give a toner application amount of 1.00 mg/cm$^2$. The evaluation apparatus was used to form a solid image having a coverage of 100% on A4 size paper, and it was confirmed whether or not the paper wrapped around a fixing roller. The above-described series of steps were performed while the toner application amount was changed from 1.00 mg/cm$^2$ to 1.80 mg/cm$^2$ in increments of 0.1 mg/cm$^2$. Toner application amounts for which the paper did not wrap around the fixing roller were determined to be "fixable and releasable toner application amounts".

Post-fixing releasability was evaluated in accordance with the following standard. The evaluation results are shown in Table 6.

Excellent: Greatest fixable and releasable toner application amount≥1.4 mg/cm$^2$ Good: 1.2 mg/cm$^2$≤Greatest fixable and releasable toner application amount<1.4 mg/cm$^2$ Poor: Greatest fixable and releasable toner application amount<1.2 mg/cm$^2$ <Total UFP Number Concentration>

With respect to each of the toners TA-1 to TA-6 and TB-1 to TB-6, the total UFP number concentration was measured according to the same method as the method described in <Measurement of Number-based Particle Diameter Distribution of Fine Particles Produced through Heating> in all aspects other than that the measurement target was the toner.

The total UFP number concentration was evaluated in accordance with the following standard. The evaluation results are shown in Table 6.

Excellent: Total UFP number concentration≤1.50×10$^5$ particles/cm$^3$

Good: 1.50×10$^5$ particles/cm$^3$<Total UFP number concentration≤2.50×10$^5$ particles/cm$^3$ Poor: 2.50×10$^5$ particles/cm$^3$<Total UFP number concentration

[Evaluation Results]

Table 6 shows the evaluation results of the toners TA-1 to TA-6 and TB-1 to TB-6. "Toner application amount" in Table 6 indicates the greatest fixable and releasable toner application amount.

TABLE 6

| | | Heat-resistant stability | | Post-fixing releasability Toner | | UFP | |
|---|---|---|---|---|---|---|---|
| | Toner | Toner passage rate (%) | Evaluation | application amount ($mg/cm^2$) | Evaluation | Number concentration ($particles/cm^3$) | Evaluation |
| Example 1 | TA-1 | 90 | Excellent | 1.4 | Excellent | $1.08 \times 10^5$ | Excellent |
| Example 2 | TA-2 | 95 | Excellent | 1.3 | Good | $1.30 \times 10^5$ | Excellent |
| Example 3 | TA-3 | 80 | Good | 1.5 | Excellent | $0.98 \times 10^5$ | Excellent |
| Example 4 | TA-4 | 90 | Excellent | 1.2 | Good | $1.09 \times 10^5$ | Excellent |
| Example 5 | TA-5 | 80 | Good | 1.5 | Excellent | $2.31 \times 10^5$ | Good |
| Example 6 | TA-6 | 80 | Good | 1.4 | Excellent | $1.01 \times 10^5$ | Excellent |
| Comparative Example 1 | TB-1 | 40 | Poor | 1.6 | Excellent | $0.88 \times 10^5$ | Excellent |
| Comparative Example 2 | TB-2 | 95 | Excellent | 1.1 | Poor | $1.35 \times 10^5$ | Excellent |
| Comparative Example 3 | TB-3 | 90 | Excellent | 1.4 | Excellent | $4.11 \times 10^5$ | Poor |
| Comparative Example 4 | TB-4 | 90 | Excellent | 1.4 | Excellent | $4.02 \times 10^5$ | Poor |
| Comparative Example 5 | TB-5 | 90 | Excellent | 1.5 | Excellent | $3.80 \times 10^5$ | Poor |
| Comparative Example 6 | TB-6 | 60 | Poor | 1.4 | Excellent | $1.06 \times 10^5$ | Excellent |

The toners TA-1 to TA-6 (the toners according to Examples 1 to 6) each had the above-described basic features. Specifically, the toners TA-1 to TA-6 each included a plurality of toner particles. The toner particles each contained a binder resin and a releasing agent. The releasing agent included an ester mixture. The ester mixture included an ester and a fatty acid. The ester included at least one monoester. The monoester was a dehydration condensation product of a monovalent linear saturated carboxylic acid and a monovalent linear saturated alcohol. The fatty acid included at least one monovalent linear saturated carboxylic acid. The fatty acid included a $C_{14-24}$ monovalent linear saturated carboxylic acid but did not include a monovalent linear saturated carboxylic acid having a carbon number of less than 14 or a monovalent linear saturated carboxylic acid having a carbon number of greater than 24. The fatty acid had a melting point of at least 60° C. and no greater than 80° C. The fatty acid accounted for at least 5% by mass and no greater than 20% by mass of the ester mixture. As shown in Table 6, the toners TA-1 to TA-6 were able to maintain the toner passage rate and the greatest fixable and releasable toner application amount at high levels. The toners TA-1 to TA-6 were also able to restrict the total UFP number concentration to a low level when used for image formation.

By contrast, none of the toners TB-1 to TB-3 had the above-described basic features. Specifically, the releasing agent in the toner TB-1 (the toner according to Comparative Example 1) included a fatty acid having a melting point of less than 60° C. The toner TB-1 had a lower toner passage rate than the toners TA-1 to TA-6.

The releasing agent in the toner TB-2 (the toner according to Comparative Example 2) included a fatty acid having a melting point of greater than 80° C. The toner TB-2 had a smaller greatest fixable and releasable toner application amount than the toners TA-1 to TA-6.

The releasing agent in the toner TB-3 (the toner according to Comparative Example 3) included no fatty acid. The toner TB-3 resulted in a significantly high total UFP number concentration compared to the toners TA-1 to TA-6 when used for image formation.

The releasing agents in the toners TB-4 and TB-5 (the toners according to Comparative Examples 4 and 5) included no monoester. The toners TB-4 and TB-5 each resulted in a significantly high total UFP number concentration compared to the toners TA-1 to TA-6 when used for image formation.

The amount of the fatty acid in the toner TB-6 (the toner according to Comparative Example 6) exceeded 20 parts by mass. The toner TB-6 had a lower toner passage rate than the toners TA-1 to TA-6.

The toners TA-1, TA-4, and TA-5 each included the releasing agent R-11. The toner TA-4 had a smallest releasing agent domain dispersion size and the toner TA-5 had a greatest releasing agent domain dispersion size among the toners TA-1, TA-4, and TA-5. The toners TA-1 and TA-4 each had a higher toner passage rate than the toner TA-5. The toners TA-1 and TA-5 had a larger greatest fixable and releasable toner application amount than the toner TA-4.

What is claimed is:

1. A toner comprising a plurality of toner particles, wherein the toner particles each contain a binder resin and a releasing agent, the releasing agent includes an ester mixture, the ester mixture includes an ester and a fatty acid, the ester includes at least one monoester, the monoester is a dehydration condensation product of a monovalent linear saturated carboxylic acid and a monovalent linear saturated alcohol, the fatty acid includes at least one monovalent linear saturated carboxylic acid, the fatty acid includes a monovalent linear saturated carboxylic acid having a carbon number of at least 14 and no greater than 24 but includes neither a monovalent linear saturated carboxylic acid having a carbon number of less than 14 nor a monovalent linear saturated carboxylic acid having a carbon number of greater than 24, the fatty acid has a melting point of at least 60° C. and no greater than 80° C., and the fatty acid accounts for at least 5% by mass and no greater than 20% by mass of the ester mixture.

2. The toner according to claim 1, wherein the ester mixture has a solid point lower than a melting point thereof, a difference between the melting point of the ester mixture and the solid point thereof is at least 10° C., the melting point of the ester mixture is a peak temperature of an endothermic peak at a lowest temperature on a DSC curve of the ester mixture obtained through a second heating, and the solid point of the ester mixture is a peak temperature of an exothermic peak at a highest temperature on a DSC curve of the ester mixture obtained through cooling.

3. The toner according to claim 2, wherein fine particles are produced through the ester mixture being heated at 220° C., and a median diameter of the fine particles is at least 30.0 nm and a total number concentration of the fine particles is no greater than $3.50\times10^6$ particles/$cm^3$ in a particle diameter distribution of the fine particles as determined on a number basis.

4. The toner according to claim 1, wherein the toner particles contain at least 2.5% by mass and no greater than 7.5% by mass of the ester mixture.

5. The toner according to claim 1, wherein releasing agent domains resulting from the ester mixture are dispersed in the binder resin in each of the toner particles, and the releasing agent domains on a cross-section of the toner particle have a dispersion size of at least 0.40 μm and no greater than 1.00 μm.

6. The toner according to claim 1, wherein the monoester is a dehydration condensation product of a monovalent linear saturated carboxylic acid having a carbon number of at least 14 and no greater than 24 and a monovalent linear saturated alcohol having a carbon number of at least 14 and no greater than 24.

7. The toner according to claim 1, wherein the fatty acid is a first fatty acid mixture of myristic acid, palmitic acid, stearic acid, and arachidic acid, a second fatty acid mixture of arachidic acid, behenic acid, and lignoceric acid, or a third fatty acid mixture of myristic acid, palmitic acid, and stearic acid.

8. The toner according to claim 7, wherein the fatty acid is the first fatty acid mixture, and in the first fatty acid mixture, a content of the myristic acid is 10% by mass, a content of the palmitic acid is 10% by mass, a content of the stearic acid is 20% by mass, and a content of the arachidic acid is 60% by mass.

9. The toner according to claim 7, wherein the fatty acid is the second fatty acid mixture, and in the second fatty acid mixture, a content of the arachidic acid is 50% by mass, a content of the behenic acid is 40% by mass, and a content of the lignoceric acid is 10% by mass.

10. The toner according to claim 7, wherein the fatty acid is the third fatty acid mixture, and in the third fatty acid mixture, a content of the myristic acid is 20% by mass, a content of the palmitic acid is 60% by mass, and a content of the stearic acid is 20% by mass.

11. The toner according to claim 1, wherein the monovalent linear saturated alcohol is at least one monovalent linear saturated alcohol selected from the group consisting of myristyl alcohol, palmityl alcohol, stearyl alcohol, arachidyl alcohol, behenyl alcohol, and lignoceryl alcohol.

* * * * *